US007598831B2

(12) United States Patent
Braun et al.

(10) Patent No.: US 7,598,831 B2
(45) Date of Patent: Oct. 6, 2009

(54) RELAY WITH SELF-RESILIENT CONTACT BRIDGE

(75) Inventors: Hans Braun, Leuven (BE); Josef Weigt, Vaihingen (DE); Steffen Fuhr, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/089,936

(22) Filed: Mar. 25, 2005

(65) Prior Publication Data

US 2005/0219019 A1 Oct. 6, 2005

(30) Foreign Application Priority Data

Mar. 31, 2004 (DE) ..... 10 2004 017 160

(51) Int. Cl.
*H01H 1/00* (2006.01)

(52) U.S. Cl. ..... 335/196; 335/131; 335/132

(58) Field of Classification Search ..... 335/132, 335/196, 126, 131
See application file for complete search history.

(56) References Cited

U.S. PATENT DOCUMENTS 2,414,961 A * 1/1947 Mason et al. ..... 335/261
2,540,185 A * 2/1951 Brown ..... 335/156
2,782,282 A * 2/1957 Schrack ..... 335/281
3,238,329 A * 3/1966 Russo ..... 335/131
3,260,824 A * 7/1966 Schleicher ..... 335/193
3,272,949 A * 9/1966 Lawrence ..... 200/243
3,848,206 A 11/1974 Prouty et al.
4,029,916 A * 6/1977 Chu ..... 200/5 A
4,052,580 A * 10/1977 Stanish ..... 200/535
4,634,819 A * 1/1987 Ikeda ..... 200/16 A
4,737,750 A * 4/1988 Prouty ..... 335/177
5,021,760 A 6/1991 Krubsack et al.
7,091,805 B2 * 8/2006 Kawahara et al. ..... 335/132

FOREIGN PATENT DOCUMENTS

DE 1 200 416 9/1965
DE 38 34 155 A1 4/1990
DE 39 07 245 A1 9/1990
FR 2062060 6/1971

* cited by examiner

*Primary Examiner*—Ramon M Barrera
(74) *Attorney, Agent, or Firm*—Michael J. Striker

(57) ABSTRACT

A relay, in particular for a starter for an internal combustion engine for use in a motor vehicle. The relay has a self-resilient contact bridge, which for a reversible change in shape effected by the contact pressure, in particular widening, is embodied in curved form.

28 Claims, 4 Drawing Sheets

RELAY WITH SELF-RESILIENT CONTACT BRIDGE

FIELD OF THE INVENTION

The invention relates generically to a relay.

BACKGROUND OF THE INVENTION

Relays are known. They have contact bridges that cooperate with associated counterpart contacts in order to close a load current circuit that is to be switched. Relays for internal combustion engine starters, because of the high currents to be switched, have contact bridges, which because of the high current-carrying capacity required have a large conductor cross section. Because of the large conductor cross section, the contact bridges are embodied as substantially solid. In the prior art, it is known to position such contact bridges vertically to the switching axis on a contact bridge holder that makes a defined switching actuation possible by means of a compression spring (spiral spring) and a contrarily acting restoring spring. The contact bridge is electrically disconnected by an insulating bush from the components that support it, in particular the contact bridge holder and the compression spring. These known embodiments are known as externally sprung contact systems.

Solid contact bridges as described above tend to recoil upon closure of the contact. In the course of the abrupt switching event (contact closure), ionization of the gas molecules surrounding the respecting contacts and sparking occur because of the high current intensities. This causes burnoff of the contact faces, and under some circumstances, especially with worn contacts, it causes the contacts to fuse to one another in the closed state, because of the severe heating caused by the spark. In that case, the relay contact can no longer be opened. In the case of the aforementioned recoiling event, contact interruptions occur as well as (because of the recoiling event) increased sparking. It is also disadvantageous in these constructions that contact wear, for instance from burnoff, worsens the contact position; in other words, the contact faces of the contact bridge and of the associated counterpart contacts no longer touch over their full surface. With increasing wear of the contact faces, particularly from burnoff (loss of material from the above-described sparking), the available contact face, or in other words the surface area at which the contacts in fact close reliably, decreases; at the same time, the air gap that exists in the open state of the relay between the contact bridge and the counterpart contact becomes larger. Another disadvantage of the prior art is that the cylindrical contact compression spring in conventional contact systems occupies a relatively large amount of installation space and disadvantageously determines the axial structural length of the relay. The axial structural length is understood to mean the elongation of the relay along the switching axis that receives the contact bridge (that is, perpendicular to the elongation of the contact bridge and along the actuation path).

SUMMARY OF THE INVENTION

By comparison, the invention offers the advantage that the contact bridge is embodied as self-resilient and has a curved embodiment, which under the contact pressure that occurs in the switching actuation allows a reversible change in shape of the contact bridge, and in particular a (for instance slight) widening of the curved shape. Widening of the curved shape is intended to mean that the curved contour—as viewed in longitudinal section—flattens out; the end pieces of the curve accordingly have a greater spacing from one another in the deformed state. The change in shape is caused by the fact that the end pieces of the curve meet the contact faces of the counterpart contacts, causing a vector shift in the compression force that exerts the contact pressure, such that a transverse force component occurs. The result is sliding or chafing of the ends of the curve on the contact faces of the counterpart contacts; the chafing motion of the two ends of the curve extends outward and diametrically opposite, when the curved contour flattens as described above. Upon closure of the contacts, the contact faces of the contact bridge accordingly become seated on the face of the counterpart contacts, and (in the ensuing pressing of the contact bridge) are pressed slightly outward in a gentle course of motion. Because of the self-resilience of the contact bridge, which is due to the curved contour and to the properties of the material, and over the course of the actual first contact closure, the above-described, outward-oriented chafing of the contact faces on one another occurs. This is associated with cleaning of the contact faces on the contact bridge and on the associated counterpart contacts which occurs simultaneously with the contact closure and which persists over the entire service life of the relay. The chafing contact touch in the course of the seating on the contact faces removes surface substrates that are present, especially oxides and/or sulfates, by mechanical action. Moreover, because of the self-resilient embodiment and the "overpressing" of the contact bridge that lasts beyond the instant of the first actual contact closure, a burnoff reserve is formed. Even severely worn (burned-off) contacts, because of the chafing seating process, make reliable contact over a large area. This extensively assures clean, reliable contact closure.

In a preferred embodiment, it is provided that the contact bridge comprises one component with especially good spring properties and one further component with especially good conductivity and/or contact properties. Thus by means of a suitable combination of materials, whichever are the most favorable properties of the material used for each component can be exploited. The self-resilient properties of the contact bridge are determined essentially by the material of the contact compression spring and the design in terms of shape of the contact bridge, while the especially good current conductivity and/or contact-making is brought about by the material comprising the contact plate; the material of the contact place has elastic properties, for the cooperation with the contact compression spring.

In a further preferred embodiment, the contact compression spring and contact plate are adapted to one another in shape. This means that the structural shapes of the two components are adapted to one another in such a way that the most favorable possible structural dimensions, the most economical possible manufacture, and the best possible fit accuracy are obtained.

In an especially preferred embodiment, it is provided that the contact compression spring is embodied as a spring plate. The term spring plate is understood to mean a spring which develops its spring properties substantially transversely to its two-dimensional extent. Using it makes the structural size of the relay smaller.

In a further preferred embodiment, the contact compression spring and the contact plate have at least one device for rotary alignment and/or fixation relative to one another. In this way, it is assured that the two components, which to attain the best possible spring properties are not joined firmly to one another over the full surface, both maintain their relative position with respect to one another. In particular, it is provided that the two components, via the rotary alignment and/ or fixation device, are defined not only in their relative position to one another but moreover are fixed in this position; that is, a force-locking, in particular a form-locking, connection between these two components is produced at precisely this point (and preferably only at this point).

In a preferred embodiment, it is provided that the contact pressure plate and the contact compression spring, in the form of individual components, are joined together by means of an extension of material, comprising one component, through an opening in the other component. To that end, in the region of the curve of the contact bridge, an opening is made in one component, while the other component is given a smaller opening; the axes of the openings are aligned with one another. By means of a suitable creative shaping operation, the material of the component that has the smaller opening, which material protrudes into the larger opening in the other component, becomes deformed such that it passes through the larger opening and overlaps the opposite side in the peripheral region of the opening. This process can be done for example as a pressing and riveting process. If the openings in the components are made not exactly circular but rather oval or some other shape that deviates geometrically from a circle, thus creating a means of rotary alignment, not only can the components be fixed to one another but they can also be fixed in terms of their relative rotational position to one another (rotary alignment means). If the two components are connected to one another by form locking, as is preferable, their relative position is thus stably fixed.

In a further especially preferred embodiment, the above-described material extension is to be embodied such that it is brought about by material comprising the contact place, which engages the larger opening made in the contact compression spring and is crimped over on the diametrically opposite side. That is, the material extension is effected from the material that has the particularly good contact properties as well as the particularly good current-carrying capacity. When the material extension is manufactured, it is contemplated that if at all possible, only slight stretching and thus only a slight reduction in cross section or thickness of the contact plate material be brought about. This embodiment causes the reduction in conductor cross section, which necessarily-results from loss of material when the openings are made in the contact place and the contact compression spring, can be compensated for; that is, the material extension contributes to the current-carrying capacity. Especially good compensation for this production—dictated reduction in conductor cross section can be achieved if the contact bridge has a thickened portion in the region of the openings that are made.

In a further preferred embodiment, it is provided that a contact bridge holder is assigned to the contact bridge and engages the curved region of the contact bridge. In particular, it is provided that this contact bridge holder be made to engage approximately at the axis of symmetry of the contact bridge. This axis of symmetry coincides with the axis of the switching motion. The switching motion of the contact bridge is executed by means of the contact bridge holder. In the course of the switching event, the contact bridge holder moves together with the contact bridge in the direction of the counterpart contacts assigned to the contact bridge, while upon opening of the contacts it moves in the opposite direction.

In an especially preferred embodiment, it is provided that the contact bridge holder be made of insulating material. The insulating bushes that are usual in the prior art and that electrically disconnect the contact bridge and the contact compression spring and/or the contact restoring spring from one another, can accordingly be omitted. Preferably, the contact bridge holder of insulating material is embodied as a switching pin, which not only carries the contact bridge but in turn effects the switching motion of the contact bridge.

In a preferred embodiment, a rotary alignment and/or fixation device is provided, which defines the contact compression spring, the contact plate, or both in their relative position with respect to the contact bridge holder. To that end, the opening described above, for instance, which is not circular but oval or embodied in some other geometrically suitable way in the contact plate and the contact spring, not only forms a material extension acting as a current-carrying capacity amplification zone and as a rotary alignment and/or fixation device of the contact place and the contact compression spring relative to one another, but moreover makes it possible to insert the contact bridge holder through the contact bridge, so that precisely because of the rotary alignment and/or fixation device, the contact bridge is seated in a precisely defined position on the contact bridge holder. The cross-sectional geometry of the contact bridge holder in the seating plane of the contact bridge and the geometry of the opening in the contact bridge correspond to one another.

It is also preferably provided that the contact bridge, seated in this way on the contact bridge holder, be retained on the contact bridge holder by means of a clamping disk. The clamping disk is understood to be a component which is slipped, by means of an opening located in it, onto the end of the contact bridge holder that holds the contact bridge; peripheral regions of the opening that are embodied in the form of tabs or teeth, for instance, bend outward in the direction of the insertion motion of the contact bridge holder and in the process notch into tree material comprising the contact bridge holder. The result is a blocking action in the direction extending opposite the insertion motion. The contact bridge is consequently fixed on the inserted end of the contact bridge holder. It is thus assured that the contact bridge has a precisely defined location inside the relay arrangement, so that loosening or slippage or longitudinal and/or axial play relative to the axis of the switching motion can as much as possible be precluded. It can thus be prevented that the outer contour of the contact bridge will scrape or scratch the relay housing or switch cap, for instance, causing abrasion of housing material, which could spoil the contact faces and worsen the contact- making process. This also assures that the switching event will be executed without hindrance from external mechanical braking or blocking factors caused by the scraping of the contact bridges on the relay housing or switch cap.

In an especially preferred embodiment, it is provided that the contact bridge, to embody its curved shape—viewed in longitudinal section—be embodied approximately in a U shape, and that the free ends of the legs of the U be made to extend curving outward. Such an embodiment makes it possible for the ends of the legs to have a shaping which promotes the above-described sliding-on motion onto the contact faces of the counterpart contacts and that necessarily predetermines the direction of the sliding motion.

DETAILED DESCRIPTION OF THE PREFERRED EMBODIMENTS

Figure 1:
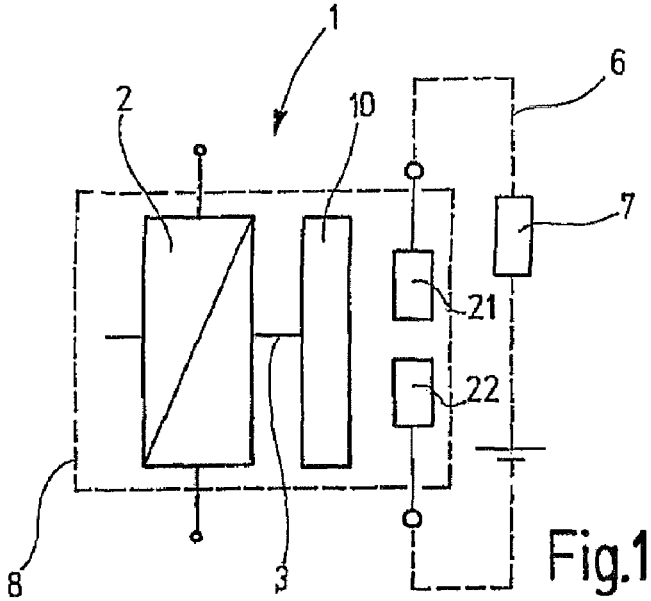
FIG. 1 is a schematic illustration of a relay.

FIG. 1 schematically shows a relay 1 with a magnet coil 2 and an armature 3. A contact bridge 10 is associated with the armature 3. The contact bridge 10 cooperates with two counterpart contacts 21 and 22. A load current circuit 6 with at least one consumer 7 is also shown symbolically. The relay 1 has a housing 8, shown only schematically. Upon excitation of the magnet coil 2, the armature 3 is actuated and causes the closure of the load current circuit 6, by moving the contact bridge 10 until it rests on the counterpart contacts 21 and 22.

Figure 2:
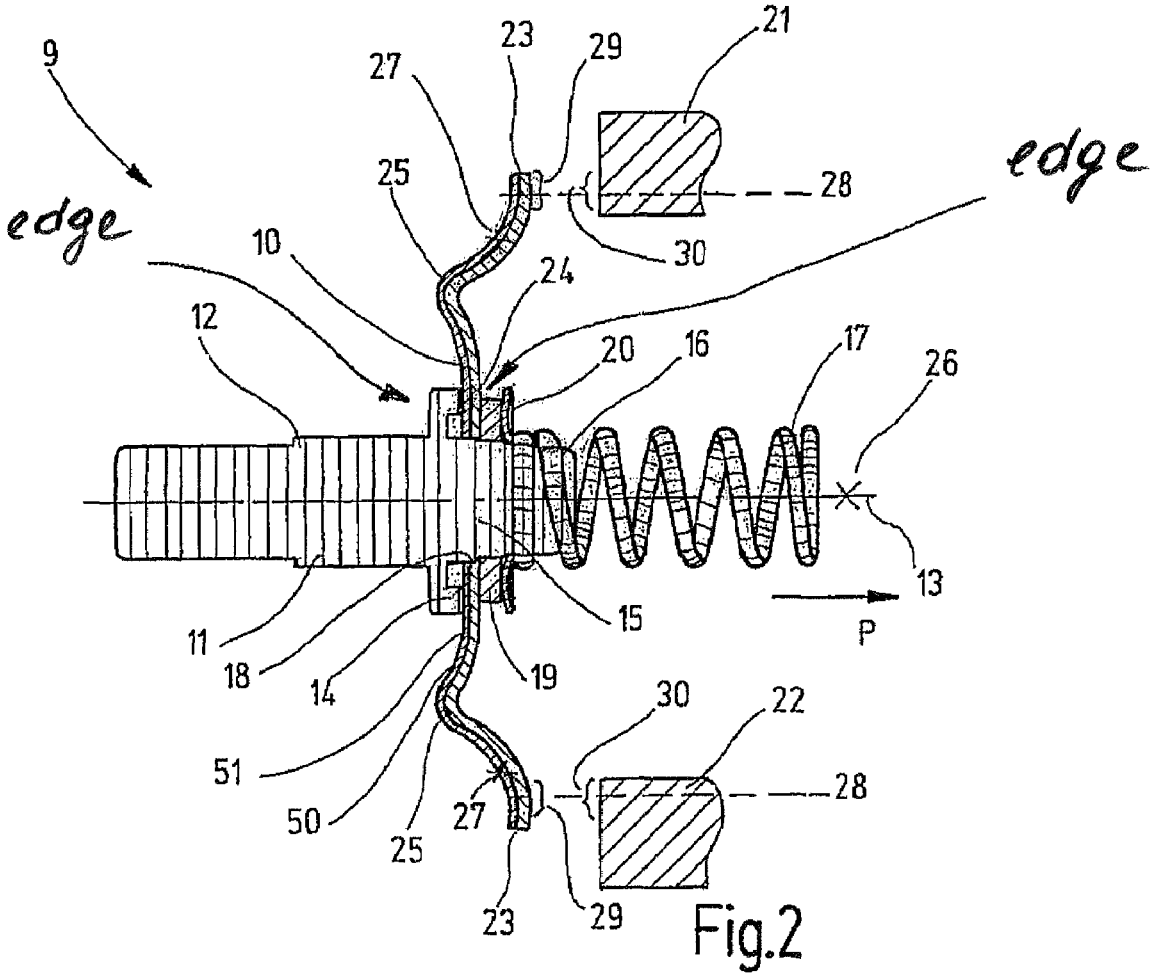
FIG. 2 shows a contact bridge arrangement with counterpart contacts.

FIG. 2 shows the region of the relay 1 that is relevant to the invention, namely a contact bridge assembly 9, comprising a contact bridge 10 and a contact bridge holder 11 that is embodied as a switching pin 12. The switching pin 12 extends coaxially to the switching axis 13. The contact bridge holder 11 has a contact bridge bearing surface 14 and a contact bridge receptacle 15 that extends coaxially to the switching axis 13. The contact bridge receptacle 15 has a tapered end 16, which engages the inside of a restoring spring 17. The contact bridge receptacle 15 reaches through an opening 18, which is embodied in this case centrally in the contact bridge 10. The contact bridge 10 rests on the contact bridge bearing surface 14. On the side of the contact bridge 10 diametrically opposite the contact bridge bearing surface 14, a spacer disk 19 rests on the contact bridge 10 and is fixed by means of a clamping disk 20. In the position shown, in which the magnet coil 2 of the relay 1 is not excited, the contact bridge 10 is located spaced apart from and diametrically opposite the counterpart contacts 21 and 22. The contact bridge 10 has a substantially curved contour, on the order of a U that is flared at the legs. The ends 23 of the legs are bent open outward, that is, away from the switching axis 13. Moreover, in contact on both sides with its substantially two-dimensional middle part 24, corresponding approximately to the length of the contact bridge bearing surface 14, the contact bridge 10 has a bend 51 extending to a turning point 50. This is adjoined by a reverse bend 25, which extends in kneelike fashion in the direction of the ends 23 of the legs extending to the counterpart contacts 21 and 22. Viewed from an imaginary viewpoint 26 on the switching axis 13, the longitudinal sectional contour of the contact bridge 10 is initially two-dimensionally flat when viewed outward from the switching axis 13 and is then convex as far as the turning point 50 and concave in the reverse bend 25, and then approximately from a turning point 27 onward it assumes a convex embodiment again.

The switching pin 12, which acts as a contact bridge holder 11, is joined, on its end diametrically opposite the restoring spring 17, to the armature 3, not shown, which is located in a magnetic field that develops upon excitation of the magnet coil 2, not shown. The counterpart contacts 21 and 22 are located in the load current circuit 6 to be switched. In the course of the closure of the load current circuit 6, that is, for conducting current from the counterpart contact 21 to the counterpart contact 22 via the contact bridge 10, the switching pin 12 and the contact bridge assembly 9 are moved counter to the restoring force of the restoring spring 17 along the switching axis 13 onto the counterpart contacts 21 and 22. A first two-dimensional contact of the contact bridge 10 with the counterpart contacts 21 and 22 takes place. The region of the first contact closure is schematically represented by the normal line 28; the contact closure takes place not at a point but two-dimensionally. The contact face 29 of the contact bridge meets the contact face 30 of the counterpart contacts in the process. After the first arrival of the contact faces 29 of the contact bridge at the contact faces 30 of the counterpart contacts in the arrival axis 28, further shifting of the contact bridge assembly 9 in the direction of the arrow P along the switching axis 13 (so-called overpressing) causes a vector shift in the force that brings about the contact bridge motion and that engages the contact bridge 10 in the switching axis 13 via the contact bridge bearing surface 14. As a consequence of this vector shift, some of the engaging force causes the elastic (reversible) deformation of the contact bridge 10, in such a way that the ends 23 of the legs are pressed outward, away from the switching axis 13. The ends 23 of the legs, or in other words the contact bridge contact faces 29, are moved outward in the course of this elastic deformation, out of the position in the two- dimensional area represented by the normal line also called the arrival axis 28, so that the contact bridge contact faces 29 are moved in the direction of the outside of the counterpart contacts 21 and 22 (that is, away from the switching axis 13). This causes a chafing sliding of the contact bridge contact faces 29 onto the counterpart contacts 21 and 22, in the process of which an area on the counterpart contacts 21 and 22 that is somewhat larger than the actual contact face 30 of the counterpart contacts is swept over. When the end point of the actuating course of the contact bridge assembly 9 seated on the switching pin 12 is reached (that is, the closing state of the load current circuit), the ends 23 of the legs rest on the counterpart contacts 21 and 22, via the contact bridge contact faces 29. This chafing sliding-on action brings about a mechanical cleaning, which occurs each switching actuation, of the contact faces 29 of the contact bridge and the contact faces 30 of the counterpart contacts, or of larger areas on the ends 23 of the legs of the contact bridge 10 that are resting on something in the state when the contacts are closed, and of the associated areas of the counterpart contacts 21 and 22. Oxide and/or sulfite films, in particular, are easily eliminated in-this way, assuring malfunction-free contact-making and assuring that unnecessarily high transition resistances will not occur between the contact bridge 10 and the counterpart contacts 21 and 22. Moreover, a burnoff reserve is formed as a result of the fact that, in the course of the above-described overpressing of the contact bridge, after the initial touching of the contact bridge contact faces 29 and contact faces 30 of the counterpart contacts, in the respective arrival axis 28, the actuation course along the switching axis 13 does not yet end; instead, a further motion takes place, counter to the spring force of the contact bridge 10. Wear of the contact bridge contact faces 29 and the contact faces 30 of the counterpart contacts, that is, of the counterpart contacts 21 and 22, caused for instance by burnoff, can thus be largely compensated for. Because of the travel reserve described above, it is assured that even severely worn counterpart contacts 21 and 22 and/or a severely worn contact bridge 10 will enable reliable contact-making, in order to prevent a corresponding electrothermal effect (heating up to the point of fusing).

Figure 3:
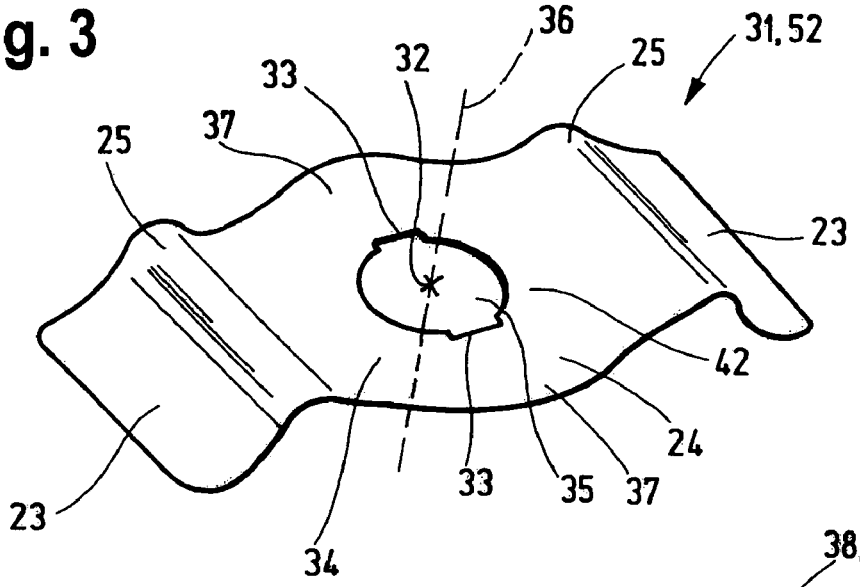
FIG. 3 shows a contact compression spring.

FIG. 3 shows a first component 52, namely a contact compression spring 31 which is made of spring material, of a contact bridge 10 constructed of two components 52. The contact compression spring 31 has the substantially U-shaped contour already described above, and in particular has a substantially two-dimensional middle part 24 and the already described reverse bend 25. The reverse bend 25 can also be called a knee, which enables a certain "hinge action" with regard to the ends 23 of the legs in motion relative to the two-dimensionally defined middle part 24 of the contact compression spring 31. The contact compression spring 31 has a contact compression spring opening 32, which has two-recesses 33 open at the periphery. The recesses 33 open at the periphery are made as cuts, which enlarge the opening, into the spring material 34 of the contact compression spring 31. The contact compression spring 31 has bulging thickened portions 37 on both long sides around the contact compression spring opening 32. The bulging thickened portions 37 bring about compensation for the reduction in cross section caused by making the contact compression spring opening 32 in the spring material 34 of the contact compression spring 31. The spring material 34 of the contact compression spring 31 preferably comprises a suitable bronze, or materials in which the tensile strength (spring bending limit) can be optimally utilized.

Figure 4:
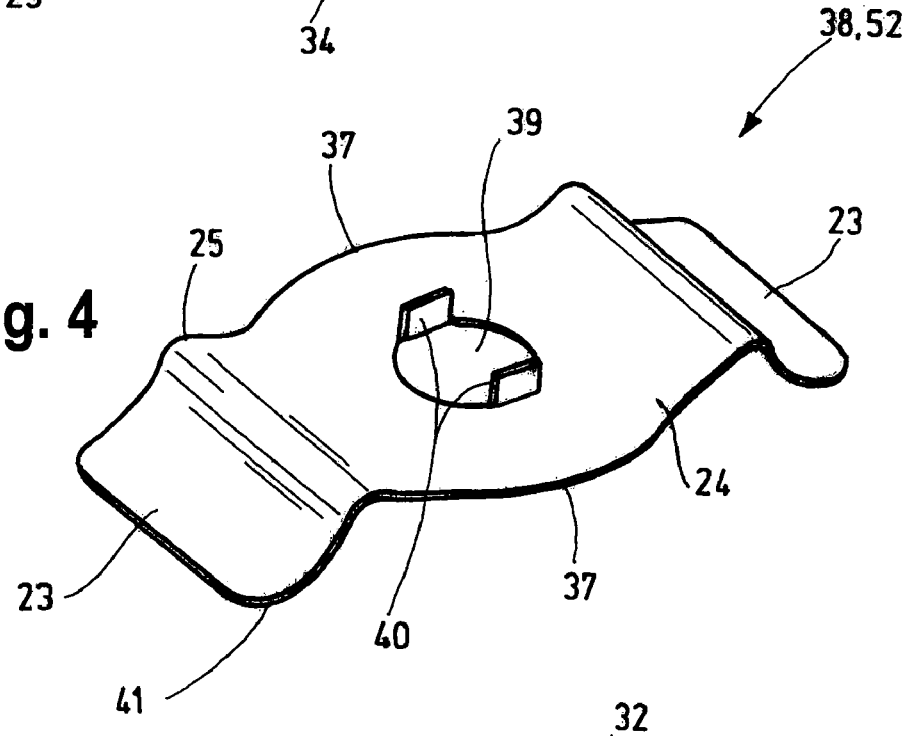
FIG. 4 shows a contact plate.

FIG. 4 shows the second component 52, namely a contact plate 38, of the contact bridge 10 constructed of two components 52. The contact plate 38 is adapted in shape to the contact compression spring 31 shown in FIG. 3, specifically in terms of both its outer contour and its three-dimensional extent. In particular, the contact-plate 38 has the legs 23 of the ends, the reverse bend 25, and the bulging thickened portion 37. The contact plate 38 also has a contact plate opening 39, which has essentially the same diameter as the above-described contact compression spring opening 32. Material tabs 40 are provided that are integral with the contact plate 38. These tabs protrude perpendicular to the two-dimensional extent of the middle part 24. The contact plate is made of a contact plate material 41, for which especially conductive materials with a high current-carrying capacity are preferably used. For instance, using oxygen-free conductive copper as the contact plate material 41 is contemplated.

Figure 5:
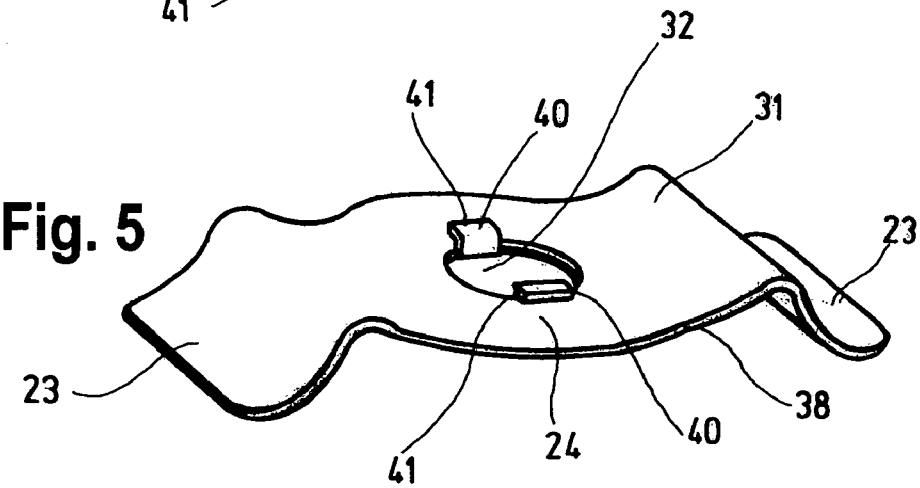
FIG. 5 shows an installed contact bridge, made up of a contact compression spring and a contact plate.

FIG. 5 shows the contact compression spring 31 and the contact plate 38 after assembly to make the contact bridge 10. Because of the adaptation in shape of the components 52, that is, the contact compression spring 31 and contact plate 38, they rest flush and two-dimensionally shape-adapted on one another. At the same time, displaceability of the two components relative to one another that reinforces the self-resilient effect is attained if upon relay closure, an exertion of contact pressure against the ends 23 of the legs takes place, with an engagement point of the force that effects the contact pressure being located approximately in the center of the two-dimensional middle part 24. The tabs 40 of contact plate material 41, after reaching through the contact compression spring opening 32, are bent over onto the surface 42 of the contact compression spring 31. A form-locking, reliable fixation of the two components to one another and an unambiguously defined, reliable orientation to one another are thus achieved.

In a departure from the embodiment of the contact bridge 10 shown here, in the form of a version composed of the components 52, that is, the contact compression spring 31 and contact plate 38, it is understood also to be possible, depending on the field of use, to embody the contact bridge 10 in one piece, that is, not of a contact compression spring 31 and a contact plate 38. In that case, certain limitations must be made in terms of the spring property and current conduction and current-carrying capacity of the contact bridge 10, but this may suffice for the intended use in individual cases. It is possible in this respect to use such materials as copper beryllium, depending on the intended use. In a two-piece version, combinations of material are equally possible within wide limits, particularly made of the following materials: spring steel CK75 quenched and subsequently either drawn or not, copper-zinc alloys (brass), or copper-tin-zinc alloys (nickel silver).

Figure 6:
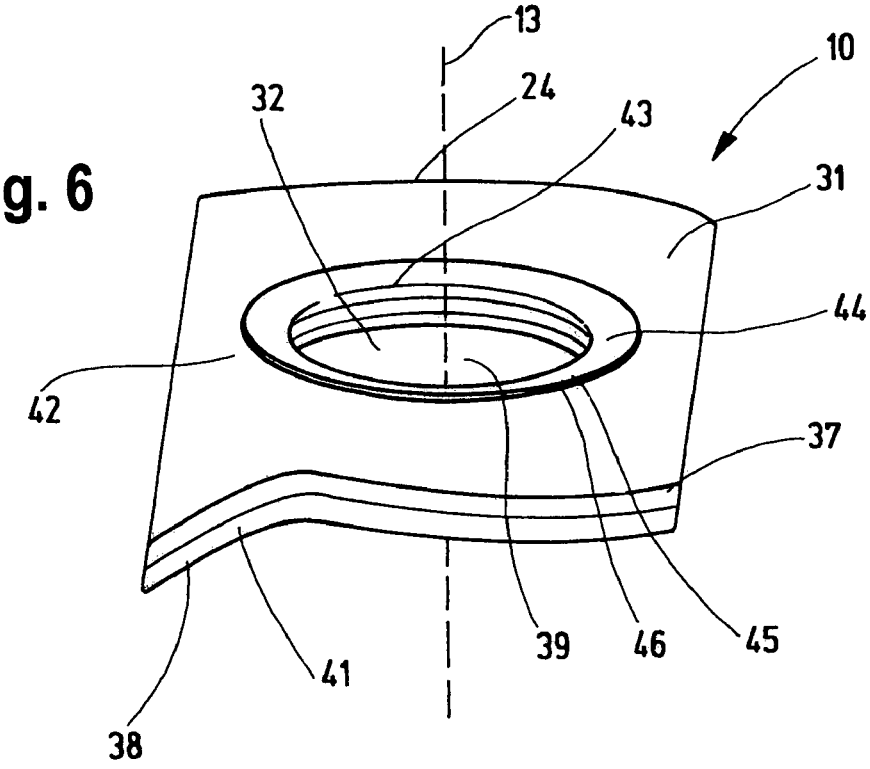
FIG. 6 shows a material extension of the contact bridge in the form of a rotary alignment and fixation device.

FIG. 6 shows a further exemplary embodiment of a contact bridge 10, in which the joining of the components 52 is accomplished by means of a material extension 43, in detail; namely, it shows the two-dimensionally embodied middle part 24 with the bulging thickened portion 37. The contact bridge 10 is assembled from the components 52, that is, the contact compression spring 31 and the contact plate 38. Here, the fixation of these two components is effected by the material extension 43 of the contact plate material through the contact compression spring opening 32. After passing through the contact compression spring opening 32, the material extension 43 is bent over or crimped over toward the contact compression spring surface 42; this creates a bead 45 of material. The result is a form locking connection of the contact compression spring 31 and the contact plate 38 via the material extension 43. Preferably, the material extension 43 is manufactured such that a contact compression spring opening 32 is made in the contact compression spring 31 and a contact place opening 39 is made in the contact plate 38. The contact plate opening 39 should be made smaller in diameter than the contact compression spring opening 32, namely preferably in such a way that, in the deformation of the contact plate material 41 which brings about the material extension, no substantial stretching of the contact plate material, with an attendant reduction in cross section or thickness, occurs in the region of the material extension 43. Especially good current-carrying capacity is thus accomplished, which compensates for the reduction in cross section that results from the making of the openings 32, 39 in the contact compression spring and the contact place. The material extension 34 accordingly forms a current-carrying capacity amplification zone 46. Moreover, by reducing the electrothermal load, the overall service life of the contact bridge is increased. If the openings 32, 39 are not precisely circular but instead oval, for instance on the order of an ellipse, then they also act as a rotary alignment device 44 relative to the contact bridge holder 11, not shown here, which is to be embodied with a suitable cross-sectional geometry, or its contact bridge receptacle 15 that reaches through the openings 32, 39. Since the shaping of the openings 32, 39 and of the contact bridge receptacle 15 is not circular but rather oval in a way adapted to the contour, there is no play of the contact bridge 10 about the switching axis 13.

Figure 7:
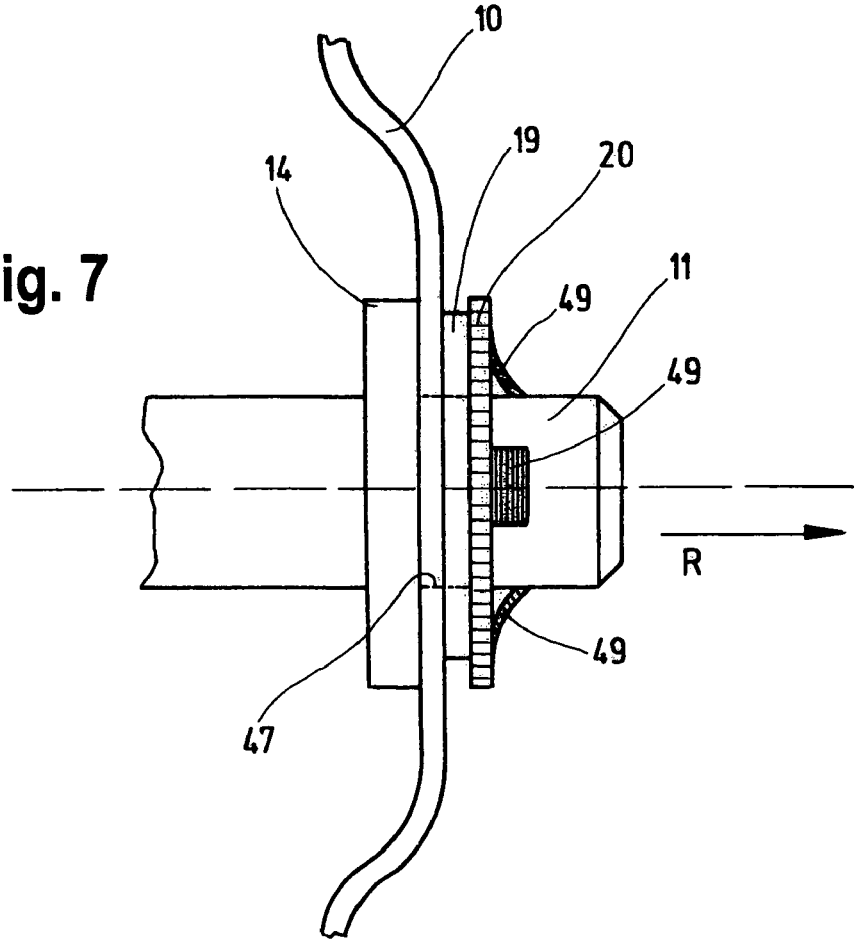
FIG. 7 is a detail of a contact bridge fixation by means of a clamping disk.

FIG. 7 shows how the contact bridge 10 is retained on the contact bridge holder 11 by means of the clamping disk 20. The contact bridge 10 is mounted on the contact bridge holder 11 by slipping the contact bridge opening 47, located in the contact bridge 10, over the end of the contact bridge holder, which end acts as a contact bridge receptacle 15. The contact bridge 10 then rests on the contact bridge bearing surface 14. A spacer disk 19 is also provided between the contact bridge 10 and the clamping disk 20. Integral tabs 49 are embodied in the opening of the clamping disk 20, and between them there is an opening diameter of the clamping disk that is somewhat smaller than the outside diameter of the contact bridge receptacle 15. As a result, upon being inserted in the insertion direction R, bending outward of the integral tabs 49 is brought about, causing them to press in a self-inhibiting fashion against and/or into the material making up the contact bridge receptacle 15.

Figure 8:
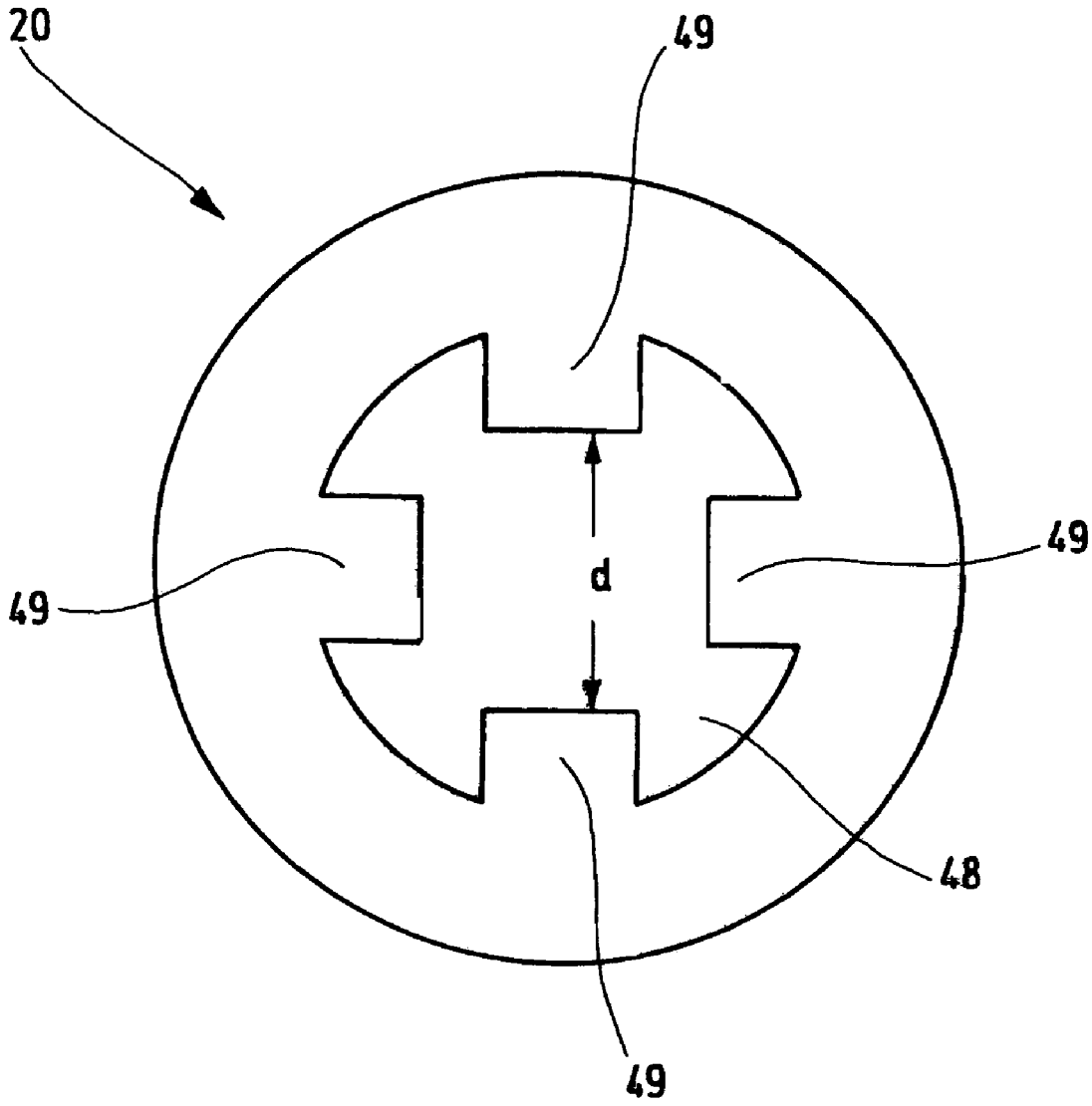
FIG. 8 shows a clamping disk for fixation of the contact bridge.

FIG. 8 shows a clamping disk—embodied in circular form—in a top view, with four integral tabs 49 inside the clamping disk opening 48. The opening diameter d results between the integral tabs 49. It is understood that the clamping disk may also have a greater or lesser number of integral tabs 49, as long as the blocking action described is brought about. It is also understood that the clamping disk may have a different shape than the circular shape.

The invention claimed is:

1. A relay, having a contact bridge, wherein the contact bridge (10) is self-resilient and is embodied in curved form for a reversible change in shape, occurring as a result of contact pressure, wherein the contact bridge (10) has a contact compression spring (31) and a contact plate (38) that is acted upon by the contact compression spring (31), and wherein the contact compression spring (31) and the contact plate (38) are embodied as adapted in shape to one another, wherein counterpart contacts (21, 22) are provided and arranged so that in a closed condition of the relay, the contact plate (38) directly contacts the counterpart contacts (21, 22), wherein the contact plate (38) has a contact plate opening (39) and the contact compression spring (31) has a contact compression spring opening (32), wherein the relay further has a switching pin (12), wherein the contact plate (38) and the contact compression spring (31) are jointly held on the switching pin (12) by the contact plate opening (39) and by the contact compression spring opening (32) correspondingly, wherein the contact compression spring (31) and the contact plate (38) lie over one another directly around the switching pin, when the contact plate (38) is spaced from the counterpart contact (21, 22).

2. The relay as recited in claim 1, wherein the contact compression spring (31) is embodied as a spring plate.

3. The relay as recited in claim 1, wherein the contact compression spring (31) and the contact plate (38) have at least one device (44) for rotary alignment and/or fixation relative to one another.

4. The relay as recited in claim 1, wherein the contact compression spring (31) and the contact pressure plate (38) are joined, by a material extension (43) of one component (52) through an opening in the other component (52).

5. The relay as recited in claim 4, wherein the material extension (43) is located in the contact plate (38) and is embodied as a current-carrying capacity amplification zone (46).

6. The relay as recited in clam 1, wherein a contact bridge holder (11), effects the switching motion of the contact bridge (10) and engages a curved region of the contact bridge (10).

7. The relay as recited in claim 6, wherein the contact bridge holder (11) comprises insulating material.

8. The relay as recited in claim 6, wherein the contact compression spring (31) and/or contact plate (38) has at least one device for rotary alignment and/or fixation relative to the contact bridge holder (11).

9. The relay as recited in claim 6, wherein the contact bridge (10) is retained on the contact bridge holder (11) by means of a clamping disk (20).

10. The relay as recited in claim 1, wherein the contact bridge (10), for developing its curved shape—as viewed in longitudinal section—is embodied as approximately U-shaped, and the free ends of the legs of the U extend in curved outward fashion.

11. A relay as recited in claim 1, wherein the relay is configured for a starter for an internal combustion engine for use in a motor vehicle.

12. A relay as recited in claim 1, wherein the contact bridge (10) is self-resilient and is configured in curved form for reversible change in shape residing in widening.

13. A relay as recited in claim 4, wherein the contact compression spring (31) and the contact pressure plate (38) each form separate components (52).

14. A relay as recited in claim 4, wherein the contact compression spring (31) and the contact pressure plate (38) are joined in form-locking fashion.

15. A relay as recited in claim 4, wherein the material extension (43) of one component (52) extends through the opening which is a substantially oval opening in the other component (52).

16. A relay, having a contact bridge, wherein the contact bridge (10) is self-resilient and is embodied in curved form for a reversible change in shape occurring as a result of contact pressure, wherein the contact bridge (10) has a contact compression spring (31) and a contact plate (38) that is acted upon by the contact compression spring (31), wherein the contact compression spring (31) and the contact plate (38) have at least one device (44) for rotary alignment and/or fixation relative to one another, wherein counterpart contacts (21, 22) are provided and arranged so that in a closed condition of the relay, the contact plate (38) directly contacts the counterpart contacts (21, 22), wherein the contact plate (38) has a contact plate opening (39) and the contact compression spring (31) has a contact compression spring opening (32), wherein the relay further has a switching pin (12).

wherein the contact plate (38) and the contact compression spring (31) are jointly held on the switching pin (12) by the contact plate opening (39) and by the contact compression spring opening (32) correspondingly, wherein the contact pressure spring (31) and the contact plate (38) lie over one another directly around the switching pin, when the contact plate (38) is spaced from the counterpart contact (21, 22).

17. The relay as recited in claim 16, wherein the contact compression spring (31) and the contact pressure plate (38) are joined by a material extension (43) of one component (52) through an opening in the other component (52).

18. The relay as recited in claim 17, wherein the material extension (43) is located in the contact plate (38) and is embodied as a current-carrying capacity amplification zone (46).

19. The relay as recited in claim 16, characterized by a contact bridge holder (11), which effects the switching motion of the contact bridge (10) and which engages the curved region of the contact bridge (10).

20. The relay as recited in claim 19, wherein the contact bridge holder (11) comprises insulating material.

21. The relay as recited in claim 19, wherein the contact compression spring (31) and/or contact plate (38) has at least one device for rotary alignment and/or fixation relative to the contact bridge holder (11).

22. The relay as recited in claim 19, wherein the contact bridge (10) is retained on the contact bridge holder (11) by means of a clamping disk (20).

23. The relay as recited in claim 16, wherein the contact bridge (10), for developing its curved shape—as viewed in longitudinal section—is embodied as approximately U-shaped, and the free ends of the legs of the U extend in curved outward fashion.

24. A relay as recited in claim 16 wherein the relay is configured for a starter for an internal combustion engine for use in a motor vehicle.

25. A relay as recited in claim 16, wherein the contact bridge (10) is self-resilient and is configured in curved form for reversible change in shape residing in widening.

26. A relay as recited in claim 17, wherein the contact compression spring (31) and the contact pressure plate (38) each form separate components (52).

27. A relay as recited in claim 17, wherein the contact compression spring (31) and the contact pressure plate (38) are joined in form-locking fashion.

28. A relay as recited in claim 17, wherein the material extension (43) of one component (52) extends through the opening which is a substantially oval opening in the other component (52).

* * * * *